US005127790A

United States Patent [19]

Teague

[11] Patent Number: 5,127,790

[45] Date of Patent: Jul. 7, 1992

[54] PIPE AND CASING HANDLING METHOD

[76] Inventor: J. T. Teague, P.O. Box 1126, Elk City, Okla. 73648

[21] Appl. No.: 644,957

[22] Filed: Jan. 22, 1991

[51] Int. Cl.[5] ..... E21B 19/15

[52] U.S. Cl. ..... 414/786; 414/22.55; 414/22.58; 414/22.51

[58] Field of Search ..... 414/786, 22.54, 22.55, 414/22.58, 22.61

[56] References Cited

U.S. PATENT DOCUMENTS

| | | | |
|---|---|---|---|
| 2,539,751 | 1/1951 | Olsen | 414/22.58 |
| 2,589,181 | 3/1952 | Yount | 414/22.61 |
| 2,743,823 | 5/1956 | Breedlove | 414/22.58 |
| 3,613,905 | 10/1971 | Woolsayer et al. | 414/22.55 |
| 3,655,071 | 4/1972 | Langowski et al. | 414/22.58 |
| 3,785,506 | 1/1974 | Crocker et al. | 414/745.8 |
| 3,860,122 | 1/1975 | Cernosek | 414/745.8 X |
| 4,403,898 | 9/1983 | Thompson | 414/22.58 |
| 4,610,315 | 9/1986 | Koga et al. | 414/22.58 X |
| 4,708,581 | 11/1987 | Adair | 414/22.54 X |
| 4,822,230 | 4/1989 | Slettedal | 414/22.54 |

FOREIGN PATENT DOCUMENTS

| | | | |
|---|---|---|---|
| 129968 | 1/1985 | European Pat. Off. | 414/22.58 |
| 142598 | 1/1961 | U.S.S.R. | 414/22.54 |
| 2137261 | 10/1984 | United Kingdom | 414/22.55 |

*Primary Examiner*—Frank E. Werner
*Assistant Examiner*—Brian Dinicola
*Attorney, Agent, or Firm*—Gunn, Lee & Miller

[57] ABSTRACT

A method of using an apparatus for handling heavy pipe is set forth. Pipe is rolled off the end of a pipe rack into a waiting elongate trough. The trough is moved on a pair of trolley cables extending from that area up towards a rig floor, the trolley cables being raised, and the trough being pulled along the trolley cables by means of a control cable which moves the trough toward the rig floor. At a registered location, the trough is stopped and a lock device is extended on generally horizontally positioned hydraulic cylinders. The lock device is brought down onto and locks around the upper portions of the pipe. The lock device is able to support the pipe as it is rotated upwardly toward the derrick and moved into an aligned position whereby the pipe is supported vertically on the lock device free of the trough and the lower end of the pipe hangs above the rotary table ready for threading in the next step of assembly of the pipe string.

10 Claims, 2 Drawing Sheets

PIPE AND CASING HANDLING METHOD

BACKGROUND OF THE DISCLOSURE

The present disclosure is directed to an apparatus for handling pipe and especially heavy pipe which is normally denoted as casing. During the drilling of a well, the typical pipe size used in the drill string is about five inches or so. Smaller pipe is used in a well including two and three-eighths inch tubing which is placed in the well as a completion step to serve as a flow line extending to the surface. Larger pipe however is also used to complete a well, and in particular, at the casing stage, large pipe, nine inches or greater, may be placed in the well. The casing which is placed in the well is heavy because it is quite large in diameter. It is not uncommon for a joint of casing to weigh easily as much as 4,000 pounds or more. In any event, pipe of that size must be maneuvered from a pipe storage rack adjacent to a drilling rig to a position upright in the drilling rig.

The present apparatus is a system which provides both method and apparatus accomplishing this goal and a method of moving the pipe. The pipe is initially delivered and stored at the drilling rig site in a horizontal posture. The casing must be maneuvered to an upright position under the derrick. This is a relatively dangerous sequence of events.

The present inventor provided a wireline lay down apparatus which was implemented with great success in the drilling service industry. Various and sundry types of wireline operated lay down machines have been devised and implemented. The difficulty with casing is that handling by personnel is still required. The handling by personnel of heavy joints of pipe casing involves risk to the personnel and delay as the personnel attempt to keep control over the heavy pipe. Even where tubing is being handled, there is always the risk of personal injury as a result of the size, length, and weight (even as small as it may be) of the pipe being handled. Moreover, the path of travel involves movement of the pipe from a position horizontal on the pipe racks to an upright position in the derrick. The present disclosure sets forth a mechanism which is particularly adapted for handling even the heaviest of drill pipe. That is, it is adapted for handling very heavy casing to deliver the casing to a position ready for running into the well, and all of this is accomplished substantially without human pipe handling.

The present disclosure sets forth a method of maneuvering a joint of drill pipe off the end of a pipe rack where it falls into a trolley supported trough for travel from the pipe rack area toward the rig floor. The trough stops at a registered location. At that location, it supports the upper portion of the joint of pipe extending from the top end of the trough. In this location, the pipe joint can then be grasped by a locking collar. The locking collar is pivotally mounted on a pair of duplicate, extendable hydraulic rods which controllably extend and retract. This defines a set of arms which pivotally rotate so that the pipe is manuevered out of the trough where it is inclined upwardly and rotated to an upstanding position where the pipe joint is held vertically. To this end, the present apparatus utilizes a pair of duplicate extendable hydraulically operated double acting cylinders equipped with pistons and piston rods to extend the locking collar. The locking collar is maneuvered to a down position to clamp to the pipe while it is still supported in the trough. After rotation, the pipe is held in an upstanding position which is vertical with respect to the rig floor and the pipe is positioned above the rotary table. This enables the pipe to be aligned with other pipe joints previously placed in the well. This also enables the cylinders which are extended to a maximum height above the rig floor to be lowered so that the pipe is then stabbed into the casing string supported in the rotary table and thereby permits threading of the system. The elevated joint is threaded to the joints of pipe previously assembled into the casing string and it is then lowered further into the well borehole. In all instances, the pipe is mechanically handled so that human intervention is held to a minimum. This improves safety at the rig floor, and accomplishes pipe transfer much more rapidly then before. Typically, this will reduce the number of the crew handling the pipe so that crew staffing is reduced and yet speed is enhanced in handling the pipe.

While the foregoing speaks generally of the problem and describes certain aspects of the present disclosure in a rough outline, the details of this disclosure will be more readily understood on a review of the attached drawings in conjunction with the written specification found below. Moreover, the drawing set forth in apparatus, but in method or operating procedure will also be set forth so that the extremely heavy pipe including casing is transferred from the pipe storage racks adjacent to the rig to an upstanding position ready for running into a well borehole.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 3:
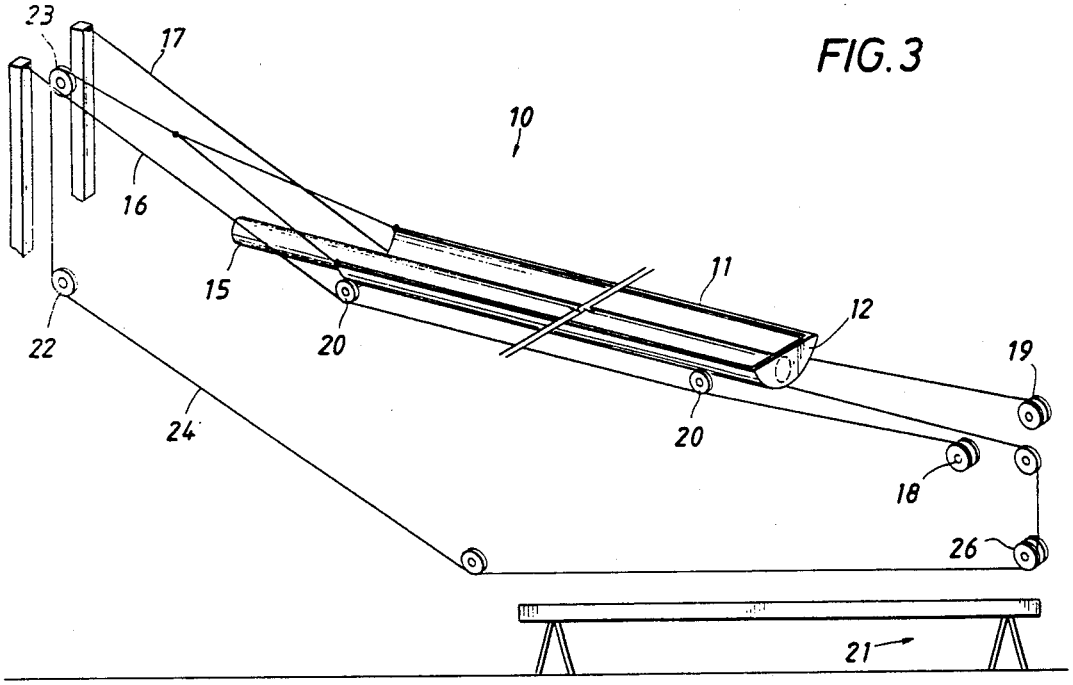
FIG. 3 is a perspective view of the trolley line supporting the trough for movement toward the rig floor while supporting a joint of pipe therein.

Attention is momentarily directed to FIG. 3 of the drawings where the numeral 10 identifies a pipe handling system in accordance with the present disclosure.

Additional equipment will be described in relation to the drilling rig shown in FIG. 1 after a description of the structure in FIG. 3. The apparatus 10 in FIG. 3 incorporates an elongate hollow trough 11 which is constructed with a back wall 12. This bulkhead closes the end of the trough so that a joint of pipe 15 placed in the trough will not slide out through the lower end of the trough. The trough is normally inclined so that the back end 12 is somewhat lower. The trough 11 can conveniently be made out of a long joint of large diameter casing which is split along its length. If the trough is to carry a pipe 15 which has a diameter of about one foot, it is desirable that the trough 11 be approximately 16 to 20 inches in diameter to provide clearance on the interior. The trough need not be as long as the joint of pipe. Indeed, it is preferable that the trough be cut shorter than the length of pipe, or alternately, a second transverse bulkhead parallel to the bulkhead 12 be welded in the trough to cause the pipe to extend out of the upper end of the trough. Reasons will be given for this later.

The trough is held where it faces upwardly. To this end, it travels on trolley lines 16 and 17. The trolley lines 16 and 17 are duplicated and extend upwardly to appropriate supporting posts or other fixed portions of the structure at the rig located somewhat above the rig floor. The lines 16 and 17 extend downwardly and are stored on drums or winches at 18 and 19. The drums or winches are preferably operated in a synchronized fashion so that the two trolley lines have equal tension in them and equal slack is provided to the two lines. This enables the trough to be balanced evenly.

The trough is supported on the trolley lines by trough wheels 20 at suitable locations. If need be, the wheels 20 can be provided with peripheral grooves so that the trolley cables 16 and 17 grip and engage the several trough wheels. The trough is moved up and down the trolley lines 16 and 17. The trough can be lowered towards the pipe rack 21 generally indicated in FIG. 3. The pipe rack is typically supported on the ground and is adapted to receive several joints of pipe on it. Typically, the pipe rack 21 will hold the entire string of pipe in a disassembled state where each joint of pipe is positioned side by side on the pipe rack. As the pipe is delivered, it is moved to the end of the pipe rack 21 joint by joint and rolled from the end of the pipe rack into the trough for transportation up to the rig floor.

The two trolley lines 16 and 17 are tightened or slacked as required in manipulation of the trough. The two synchronized drums 18 and 19 can, if desired, be positioned on a common drive mechanism so that they rotate together. Whatever the case, this supports the trough in a position facing upwardly. While it may be dipped to the level of the pipe rack 21 by providing additional slack to the trolley lines, it is also raised by tightening the trolley lines and pulling the trough to the left. Movement of the trough is subject to a control line 24. The control line 24 is rigged through several pulleys at 22 and 23 so that it is directed to the trough 11 at the upper end of the trough. The control line is connected to the trough conveniently by means of a bridle 25, and pulls the trough upwardly with an even pull. When under tension, the control line 24 can be used to pull the pipe 15 upwardly towards the rig floor. Conveniently, the control line 24 loops over a motorized sheave 26 which is powered to rotate so that the trough traverses the trolley cables 16 and 17. In this instance, the control line 24 is made in the form of a loop where it ties to the transverse bulk head 12 shown in FIG. 3. Travel uphill or up the trolley lines 16 and 17 is accomplished by movement of the trolley line in one direction, and movement in the opposite direction can also be accomplished; both are accomplished by changing the direction of rotation of the powered sheave 26. The pulleys are located so the control line is out of the way and avoids entanglement with the casing.

Figure 1:
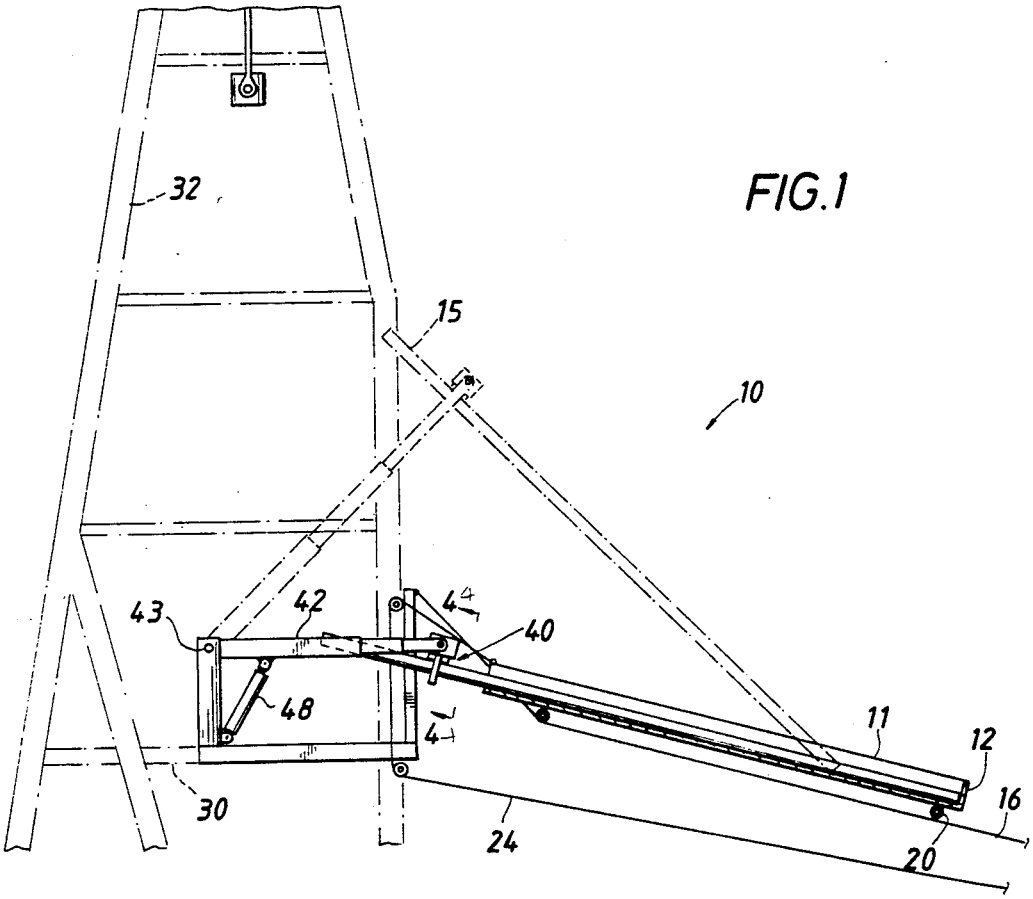
FIG. 1 shows a pipe supporting trough in accordance with the present disclosure at the top end of travel on a trolley line and additionally shows a locking collar which reaches out to grab the pipe where the locking collar is shown in full line and further showing the upward extension of the locking collar moving the pipe to a second position in dotted line.
Figure 2:
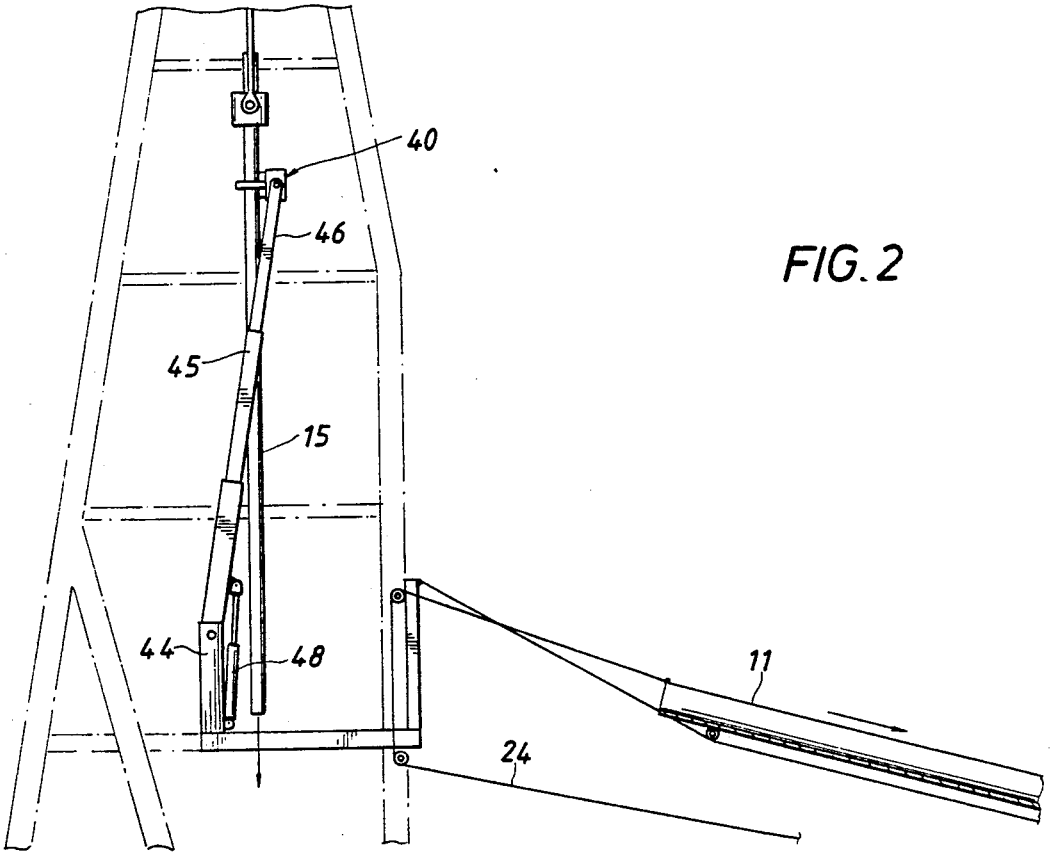
FIG. 2 is a view similar to FIG. 1 showing the pipe moved to an upright position axially aligned above the rotary table and ready for assembly in the pipe string in the well borehole.

Attention is now directed to FIG. 1 of the drawings which shows the continued travel of the pipe. As mentioned, the trough 11 is able to move to the top end of the trolley lines 16 and 17. At the upper end of its travel, it is immediately adjacent to the rig floor 30. The rig 32 is supporting structure which cooperates with the present apparatus. One purpose of this equipment is to deliver the pipe 15 to the rig floor and to accomplish this where the pipe is upstanding in the vertical position above the rig floor, and to accomplish this substantially without human handling of the pipe. The pipe will be observed in rotation and translation as it is moved from an angle outside the rig to an upstanding position under the derrick and supported by the rig elevators. In traveling from the initial position of FIG. 3 to the upstanding position of FIG. 2, the very heavy pipe may swing back and forth, striking personnel, and creating a great deal of risk. Rather than incur that risk, the present disclosure sets forth a much safer procedure. It is accomplished in step wise fashion as illustrated in FIGS. 1 and 2. FIG. 1 shows the drill pipe 15 supported in the trough 11 at the upper end of travel. It is shown in FIG. 1 engaged by a locking collar 40 which will be described in detail. The locking collar 40 is positioned to grab the pipe to the exterior of the trough 11. In other words, the pipe is grabbed and held above the open upper end of the trough 11. The locking collar is moved to this position supported by left and right duplicate hydraulic cylinders 42. The hydraulic cylinders are pivotally mounted by the pivot pin 43 to a fixed frame member 44. The frame member 44 supports the lower end of the hydraulic cylinders for pivotal movement. This pivotally movement carries the hydraulic cylinder 42 from approximately horizontal as shown in FIG. 1 nearly to an upright or vertical position as shown in FIG. 2 and represents rotation through almost 90°. Needless to say, this is accomplished in synchronized fashion with both the left and right duplicate hydraulic cylinders. The hydraulic cylinder 42 is constructed with an internal piston (not shown) which connects with an extending piston rod. The hydraulic cylinder 42 can be double acting in the preferred embodiment so that it both extends and retracts under power. In the ideal operation, it has an extendable length so that the locking collar 40 moves out by a specified distance toward the trough. The twin cylinders are illustrated with a piston rod 45 which extends out from the cylinder, and a second rod section 46 is provided in a telescoped construction. The hydraulic cylinders 42 are rotated from the horizontal to the vertical positions contrasted between FIGS. 1 and 2 by means of additional hydraulic cylinders 48. These are relatively short stroke hydraulic cylinders again equipped with pistons and connected piston rods; these two hydraulic cylinders 42 can be double acting, but they are mounted in a position where the weight of the equipment held vertically in FIG. 2 is sufficient to achieve retraction without making them double acting.

Figure 4:
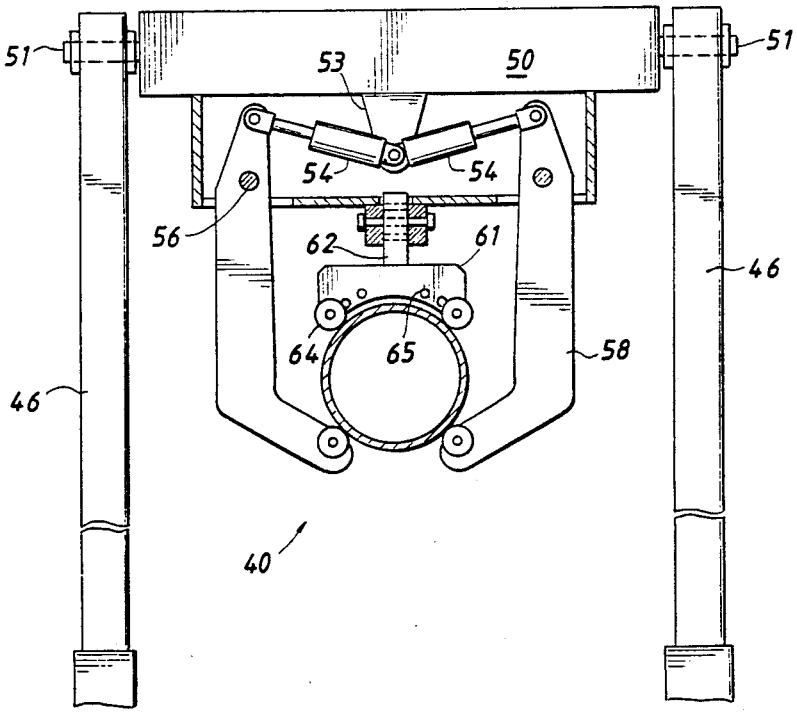
FIG. 4 is a sectional view along the line 4—4 of FIG. 1 showing details of construction of a lock collar for reaching, grasping, and holding a joint of pipe for pivotal rotation during movement toward the vertical position.

Attention is now directed to FIG. 4 of the drawings where the lock collar is better illustrated in detail. FIG.

4 shows the very upper end of the telescoped piston rods 46. This is found on both sides of the lock collar. The piston rods terminate at upper rends which connect with a frame member 50. The frame member 50 is supported on left and right duplicate trunnions 51 which enable the lock collar to pivot. It is constructed with the weight on one side to take advantage of the pull of gravity which orients the device. As shown in FIG. 1, it hangs downwardly so that it opens at the bottom to grasp the pipe which is below the lock collar. As shown in the dotted line position of FIG. 1, it is partially rotated, and it is fully rotated in FIG. 2 so that the pipe is positioned upright. This rotative movement is assisted by positioning the weight on the trunnions 51 on one side so that it hangs downwardly as illustrated. The frame member 50 spans the distance between the two hydraulic cylinders which extend and elevate the lock collar equipment. The frame member supports a fixed tab 53 which connects with duplicate left and right locking cylinders 54. They are duplicated and operate in identical fashion. The locking cylinders 54 are enclosed within a housing 55 which supports transverse mounting pins 56. The transverse pins 56 serve as pivots for pivotally mounted rotatable lock arms 58. The arms 58 face each other and are adapted to reach around the pipe 15. The arms terminate at suitable rollers which free wheel. The free wheeling rollers 60 are located at the outer extremities of the arms 58. The arms are pivotally mounted to be rotated by the hydraulic cylinders 54. FIG. 4 shows the arms in a locked position to grasp and hold the pipe. They may be moved to spread open or apart to release the drill pipe 15. On release, they open so that the rollers 60 are moved out of contact. When hydraulically powered in the opposite direction, they clamp or close. On closure, they inevitably grasp the pipe and hold if firmly as will be described. The pipe 15 is then clamped inside the clamping arms 58.

There is a yoke 61 which is adjustable to accommodate variations in pipe size. The yoke 61 is mounted on a movable base 62. The base 62 is provided with one or more openings which enable it to be pinned at a different spacing in the throat area between the two rotatable locking arms 58. The yoke 61 has a width which is sufficient to support a pair of spaced rollers 64. The symmetrically constructed rollers are positioned so that they grasp the pipe and hold the pipe against the arms 58. The yoke 61 is provided with multiple drilled holes 65 which enable the rollers 64 to be moved, thereby adjusting the opening in the throat for holding the pipe. Accordingly, the yoke 61 can be moved toward and away from the pipe, and also the rollers on the yoke can be adjusted to be closer or farther apart. The several rollers are incorporated to hold or clamp the pipe. The several rollers hold or clamp the pipe so that the pipe is firmly and fixedly held.

A sequence of operation of the present equipment should be considered. Going therefore to FIG. 3 of the drawings, the trough 11 is lowered on the trolley lines 16 and 17. The trough is retracted to the right as shown in FIG. 3. Slack is provided to the trolley lines 16 and 17 so that the trough will dip downwardly. It is lowered until it is parallel and below the pipe rack 21. A pipe joint is then rolled off the end of the rack into the trough. For this purpose, the pipe rack is normally deployed to the side of the trough in the cradle position or location. After the trough has been loaded with a joint of pipe, the trolley lines 16 and 17 are tightened so that the trolley lines are raised to an angle. The pipe does not fall out of the trough because it rests against the bulkhead 12 at the lower end of the trough. The control cable 24 is pulled in a direction to move the trough up the two trolley lines toward the rig floor. Perhaps a large scale drilling rig will serve as a good example of operation. Ordinarily the pipe racks are located about four feet above the ground. Assuming that a large rig has been drilling a well which now requires completion by casing the well borehole, the rig floor can be as high as 30 feet above the ground or approximately 24–27 feet above the pipe rack. The trolley lines might extend from the pipe rack area towards the rig floor by a horizontal distance ranging up to perhaps 125 feet. Whatever the range and height, the trough is moved up the trolley lines toward the rig floor. The trough is stopped at a specific location. This positions the upper end of the trough in a registered fashion relative to the equipment shown in FIG. 1. This also positions the pipe in a registered and predictable location for easy grasping and raising. While, it is dependent on the height of the rig above the ground and the location of the idler sheaves 22 and 23, the control cable 24 is manipulated so that the trough is moved to this position. There is little risk that the control cable will get in the way because the idler sheaves 22 and 23 are positioned so that the control cable 24 and the bridle 25 at the upper end can connect without interfering with pipe movement. In any case, the trough is brought to a registered position meaning that the pipe 15 extends toward the rig floor at a specified location.

The pipe 15 is positioned in this fashion with a box or female end at the upper end and the male or threaded pin end at the lower end butting against the bulk head in the trough. In this position, the pipe can be moved to an upright position for direct threading into the casing string.

Going now to FIG. 1 of the drawings, it will be observed that the locking collar 40 swings over at a specified location. It has a trajectory as it is rotated toward the full line position of FIG. 1. It is not too close nor is it too far from the trough. Whatever the length of pipe, the pipe is position so that the locking collar can grasp the pipe and lock around it. Moreover, the pipe is grasped in its upper half. Whatever the pipe length, it is desirable that the trough position the pipe so that grasping is accomplished in the upper half. This prevents the pipe from flipping so that the pin end is the up or raised end. In the preferred embodiment, the trough is typically in the area of about 25 to 28 feet in length so that the casing joint sticks out of the upper end by at least 2 or 3 feet. Even if a 40 foot joint is being handled and 12 feet extend above the upper trough end, that is perfectly acceptable. On a 44 foot joint which is grasped at about 28 feet above the pin end, gravity will still cause it to rotate in the desired direction to position the box end upright.

The locking collar is lowered to the pipe by operation of the hydraulic cylinders 48. This lowers the hydraulic cylinders 42 toward the horizontal and thereby positions the locking collar to grasp the pipe at a registered location. For grasping, the locking arms are held wide open and the pipe is positioned in the throat of the equipment between the two locking arms. This enables the locking arms to reach down and around the pipe and position the four rollers in contact with the pipe. If desired, the rollers can be duplicated so that there are eight rollers or two sets of four rollers each. In that event, there may be rollers both above and below the locking arms 58 and the yoke 61. In any case, the locking collar is made fast by clamping onto the pipe under operation of the hydraulic cylinders 54. Free pivotal movement around the trunnions 51 is then permitted as the two duplicate hydraulic cylinders 42 are rotated from the full line position of FIG. 1 toward the dotted line position. This raises the pipe joint out of the trough. The pin end will drag up the trough. At this stage of operation, it is usually desirable to protect the pin end with a thread protector which is a rubber cup or cap over the threads to prevent damage to the threads. The drill pipe is raised toward the dotted line position as the lower end drags up the trough. While pipe rotation occurs, the hydraulic cylinders 42 are also extended. Thus, they appear much longer in the dotted line position of FIG. 1. This raises the lock collar. Moreover, as it is being raised and rotated toward the upstanding position of FIG. 2, the pipe 15 is raised and moved toward a vertical position in the derrick. It is finally moved toward the fully upright position in the derrick. There is a moment of release when the pipe has been pulled substantially vertically and the lower pipe end slides out of the trough. There is some risk that the lower end of the pipe will swing violently when freed. As it swings, it can be quite dangerous. This apparatus and the method taught herein handle the pipes substantially without human intervention so that swinging of the pipe is no problem to personnel. That is, the rig floor can be substantially clear of personnel at this time. Needless to say, swinging is controlled if possible and held to a minimum.

The pipe is moved toward the full upright position, it being observed that the lock collar in FIG. 2 has rotated where it is nearly horizontal and pointed toward the left. The upper end of the pipe at this juncture is preferably now engaged by equipment supported in the draw works of the derrick. The draw works of the derrick operates in the conventional fashion to raise and lower a typical set of elevators which come down on and clamp around the pipe for raising and lowering the pipe. The pipe can then be positioned and lowered into alignment with the casing string already supported in the well borehole at the rotary table by conventional slips engaging the rotary table and pipe. The lower end of the pipe 15 is prepared for threading by removing the thread protector, and engaging the lower end of the pipe 15 in a set of pipe thongs for threading purposes. All the while, the upper end of the pipe 15 is held first by the lock collar of the present apparatus, and subsequently by the elevators which are clamped on the upper end of the pipe. Ordinarily, there should be sufficient length of pipe above the lock collar to permit the elevators to grab and hold the pipe above the lock collar and below the enlargement that defines the end of the pipe. The elevators grab the pipe at this place and hold up the pipe as it is threaded into the pipe string. As will be understood, the elevators support the pipe weight when the weight is released by opening the lock collar 40. Accordingly, the lock collar moves from the full line position of FIG. 2 back towards the dotted line position of FIG. 1 as it is returned towards the position of FIG. 1. This return trip is accomplished empty. The return trip sets the lock collar for handling the next joint of pipe. While the hydraulic cylinders 42 are rotated from the near vertical position of FIG. 2 back toward the horizontal, they are shortened by piston retraction. This brings the lock collar back toward the registered location so that it is able to grasp and hold the next joint of pipe.

While the present invention is being reset for the next joint of pipe, the joint previously delivered can be threaded into the casing string through conventional operations which do not interfere with the operation of this apparatus. Moreover, this equipment operates continuously while the pipe threading operations are carried on at the rig floor. As rapidly as the next joint of pipe can be picked up into the trough and moved toward the rig floor and the lock collar apparatus can engage that joint of pipe, the previous steps have threaded the next joint of pipe into the casing string and lowered the casing string in the well borehole. The present invention incorporates both a method and apparatus for handling very heavy pipe, and in particular moving it into the rig floor where human personnel can stand aside and let equipment handle the pipe. The pipe is handled in way which is quite efficient and yet which is substantially risk free. The pipe may well swing when it is released from the trolley and moved towards the upright position of FIG. 2. However, the swing is constrained to a single vertical plane so that rig personnel can stand to the side of pathway. Moreover, the tendency to swing can be reduced by constraining the range of movement of the pipe, and one to do this is to deploy a transverse bumper between the two hydraulic cylinders 42 approximately at the pivot point 43. The transverse bumper is otherwise obscured by the upstanding frame member 44 shown in FIG. 1 of the drawings.

Attention is particularly directed to the handling of the pipe at both ends, namely when loaded from the pipe racks into the trolley and when removed from the trolley for upright positioning beneath the derrick. As will be understood, at the unloading and loading steps, more injuries typically occur. Injuries can be reduced in this instance by the use of the present apparatus.

While the foregoing is directed to the preferred embodiment, the scope thereof is determined by the claims which follow.

What is claimed is:

1. A method of moving heavy pipe from a pipe rack into a derrick for incorporation in a pipe string below the derrick wherein the method comprises the steps of:

(a) moving a joint of pipe from a generally horizontal position on a pipe rack into a trough means positioned near an end of said pipe rack to receive a joint of pipe therein;

(b) moving said joint pipe of supported in while it is trough said means toward a rig floor of said derrick and thereby positioning a first end of said joint of pipe in registered location near said rig floor;

(c) extending in a generally horizontal direction towards said trough means a locking means pivotally mounted on a horizontally oriented elongate means pivotally secured above said rig floor and engaging the upper portions of said joint of pipe supported in the trough means with said locking means to grasp and hold said joint of pipe; and (d) pivoting the elongate means in an upward direction from said horizontal orientation to lift said locking means and remove said joint of pipe engaged therewith from said trough means and to align said joint of pipe with an elevator means under said derrick and above said rig floor.

2. The method of claim 1 wherein said step of extending moves said locking means outwardly from the rig floor to grasp and hold said joint of pipe at a point between said first end and a longitudinal midpoint of said joint of pipe.

3. The method of claim 1 wherein said locking means encircles a peripheral surface of said pipe on closing to hold and grasp said joint of pipe.

4. The method of claim 1 wherein the pivoting step includes rotating said elongate means supporting said locking means through an angle of approximately 90° to position said locking means above a rotary table of a derrick.

5. The method of claim 4 further including the step of extending said elongate means to a greater length during said pivoting step.

6. The method of claim 5 wherein the step of extending includes positioning said joint of pipe above said rotary table.

7. The method of claim 6 wherein said joint of pipe is held below said elevator means in the derrick, and further including the step of lowering said elevator means to engage said joint of pipe on said elevator means.

8. The method of claim 7 further including the step of releasing said joint of pipe from said the locking means after engaging said joint of pipe on said elevator means.

9. The method of claim 1 wherein the step of moving said joint of pipe includes moving said trough means along a trolley line toward the derrick and upwardly toward the rig floor thereof.

10. The method of claim 1 wherein the step of moving said joint of pipe includes rolling said joint of pipe from said pipe rack so that said joint of pipe falls into said trough means.

* * * * *